United States Patent [19]

Cronin

[11] 4,398,997

[45] * Aug. 16, 1983

[54] EXTENDED NIP PRESS

[75] Inventor: Dennis C. Cronin, Rockton, Ill.

[73] Assignee: Beloit Corporation, Beloit, Wis.

[ * ] Notice: The portion of the term of this patent subsequent to Dec. 29, 1998, has been disclaimed.

[21] Appl. No.: 302,779

[22] Filed: Sep. 16, 1981

Related U.S. Application Data

[62] Division of Ser. No. 115,010, Jan. 24, 1980, Pat. No. 4,308,096.

[51] Int. Cl.[3] ..... D21F 3/02

[52] U.S. Cl. ..... 162/274; 162/275; 162/279; 162/360

[58] Field of Search ..... 162/272, 274, 275, 358, 162/279, 360; 100/154

[56] References Cited

U.S. PATENT DOCUMENTS

| | | | |
|---|---|---|---|
| 3,783,097 | 1/1974 | Justus | 162/358 |
| 3,839,147 | 10/1974 | Daane | 162/358 |
| 3,954,557 | 5/1976 | Heim et al. | 162/272 |
| 4,201,624 | 5/1980 | Mohr et al. | 162/360 |

*Primary Examiner*—Peter Chin

*Attorney, Agent, or Firm*—Hill, Van Santen, Steadman & Simpson

[57] ABSTRACT

An extended press mechanism for removing liquid from a traveling fibrous web including a press nip formed between first and second members with one of the members being a traveling flexible impervious belt and force means engaging the inner surface of the belt including a sliding shoe facing the belt with the shoe extending transversely across the belt usually of a width less than the belt and also extending in the direction of the belt travel to form an elongated press nip with means for pressing the shoe toward the belt with a predetermined force, means for providing a film of lubricating fluid between the shoe and the belt and means for removing the excess of lubricating fluid downstream from the shoe including a wiper blade extending toward the belt flexed against the belt to wipe off the lubricant with means to remove the lubricant which is wiped off and means at the side of the shoe to wipe lubricant off the uncompressed portion of the belt and means such as ribs and grooves at the edge of the belt to prevent the lubricant from migrating around the edge onto the web side of the belt.

9 Claims, 12 Drawing Figures

Fig. 1
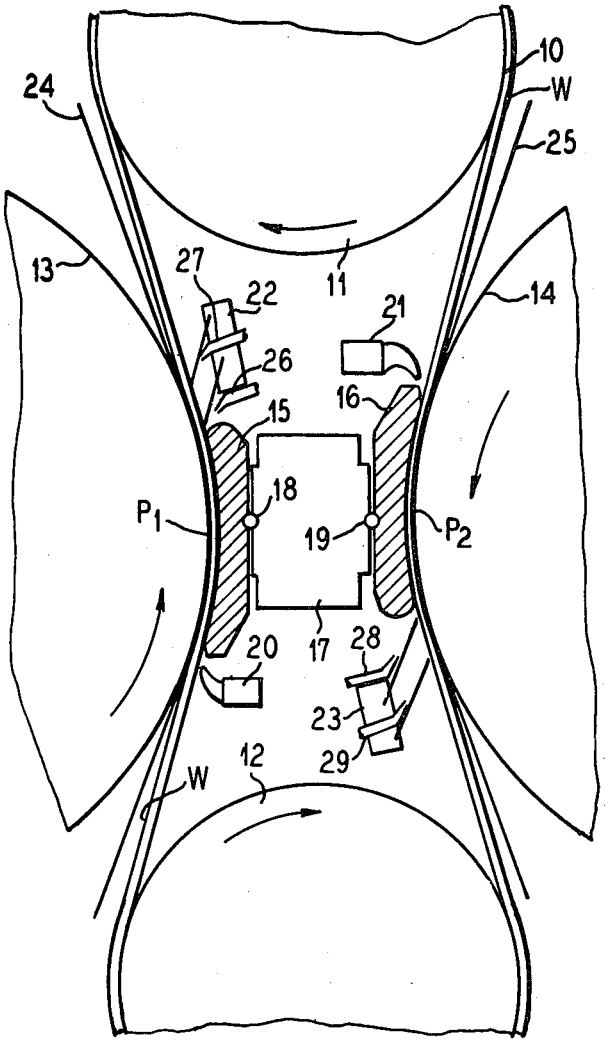
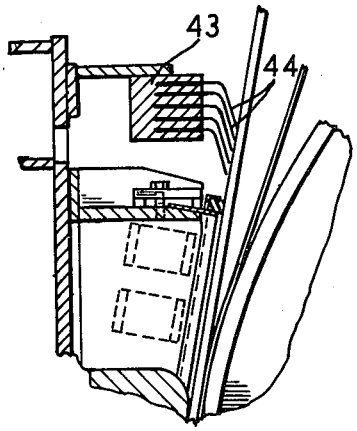
Fig. 2

EXTENDED NIP PRESS

This is a division of application Ser. No. 115,010, filed Jan. 24, 1980, now U.S. Pat. No. 4,308,096.

BACKGROUND OF THE INVENTION

The present invention relates to improvements in extended nip presses pressing water from a traveling fibrous web wherein the nip is formed by a sliding shoe having a hydraulic film of lubricating fluid between the shoe and the belt and more particularly, the invention relates to improvements in controlling the lubricating fluid for removing it from the belt downstream of the shoe and preventing the fluid from being carried along with the belt and preventing it from migrating around the edge of the belt onto the web side.

In a conventional paper making machine, after the web is formed, it is carried through a press section where the water is mechanically expressed from the fibrous web. Improvements in press sections have changed from the conventional two roll press to what has been known as an extended nip press wherein the web is subjected to a continuing pressure for a longer period of time than with the simple two roll press. Developments in these extended nip presses have included a roll as one of the pressing members with the other pressing member being a continuous impervious belt pressed toward the roll by an arcuate sliding shoe which develops a film of hydraulic lubricant between the belt and the shoe to eliminate friction and help aid in developing uniform pressure completely across the pressing zone through which the web passes. Examples of these improved sliding shoe presses are shown in U.S. Pat. No. 3,783,097, E. J. Justus and an application copending herewith, Ser. No. 939,449, Mohr et al.

The lubricating fluid which is delivered to form the hydraulic film between the shoe and traveling belt must be uniformly delivered across the web and in one form of mechanism, is provided by a series of nozzles arranged and controlled so that they deliver a lubricating fluid such as oil to the leading edge of the shoe which is relieved and forms a uniform hydraulic film completely across the shoe. As this film is formed, lubricant adheres to the belt and travels along with the belt trailing out from behind the shoe. This lubricating oil must then be controlled so that it does not continue to travel along on the surface of the belt so as to be compressed or fly off of the belt surface as the belt is carried over guide rolls. Further, the lubricating oil must be controlled so that it does not migrate toward the edge of the belt and pass over the edge where it will fly out into the surrounding atmosphere or will pass out over the edge of the belt and travel onto the web side of the belt so as to contaminate the web. The web is carried against a felt or between two felts, and these felts must be maintained to receive the water expressed from the web and satisfactory operation dictates that the lubricant cannot get into the felts to affect their water receptivity and to contaminate the web. Various means have been attempted to control and remove lubricant from the surface of the belt, but problems are presented with a belt that is traveling at speeds of 300 to 5,000 feet per minute. Further, the removal must be effected uniformly across the surface so that lubricant is not continued to be carried in streaks or ridges along with the belt so as to possibly return on the belt surface into the nip between the belt and the shoe to adversely affect the uniform pressure which must be maintained in the hydraulic film between the shoe and the belt. Further, complete removal particularly along the edges must be effected so as to prevent lubricating oil from getting out to the edges where it is thrown off by centrifugal force onto surrounding parts and where it can migrate around the edge onto the surface of the belt.

Another difficulty which is inherent in the operation of the mechanism is that the width of the belt for optimum design is wider than the shoe. This means that the portion of th flexible belt which passes beneath the shoe is compressed and is of less thickness as it emerges from beneath the shoe as compared with the portions of the belt on each side of the shoe that have not been compressed. This difference in thickness caused by the compression plus the nonuniform density of the lubricating oil across the face of the belt at the edge of the shoe makes it difficult to apply a simple removal element which treats the belt uniformly across its entire width. In other words, while the belt recovers its thickness after it passes out from beneath the shoe, at high speeds this recovery occurs after the belt has traveled some distance beyond the trailing edge of the shoe. Also, the lubricating oil which is applied between the belt and shoe must be essentially uniform across the entire width of the shoe face and yet a minimum amount of lubricating oil should be present beyond the edges of the shoe to avoid having excess oil which will fly off the belt and tend to travel outwardly to the belt edge where it can get onto the other face of the belt and contaminate the web and felts. It is also possible that a variation in viscosity can occur in the lubricating oil due to the heat generated in the lubricating oil as it passes beneath the shoe as contrasted with the oil at the edge which is not compressed between the shoe and the belt.

It is accordingly an object of the present invention to provide a method and mechanism for the removal and control of lubricating oil used to provide a hydraulic lubrication film between the shoe and belt of an extended nip press.

A further object of the invention is to provide an improved method and mechanism which permits operation of an extended nip press at high speeds and prevents the migration and escape of lubricating oil to other parts of the machine and to the edges of the belt and around the edges onto the surface of the belt which carries the felts and the web.

Other objects, advantages and features as well as equivalent methods and structures which are intended to be covered herein will become more apparent with the teaching of the principles of the present invention in connection with the disclosure of the preferred embodiments in the specification, claims and drawings in which:

DRAWINGS

FIG. 1 is a side elevational view partially in section, shown somewhat schematic, of an elongated nip press with two successive press stages constructed and operating in accordance with the principles of the present invention;

FIG. 2 is a fragmentary sectional view illustrating one form of lubricant wipers;

DESCRIPTION

Figure 3:
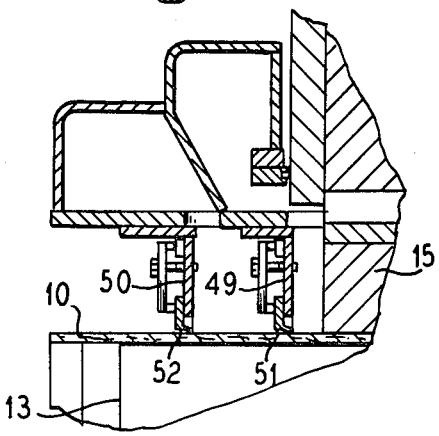
FIG. 3 is an inverted sectional view taken across a shoe on the downstream end showing edge wipers.

FIG. 1 illustrates an extended nip press construction of the general type referred to in the above referred-to patent application Serial No. 939,449, the disclosure of which is incorporated herein by reference.

The press includes an endless impervious belt 10 supported on separated parallel drive and guide rolls 11 and 12. The belt passes over two press rolls 13 and 14 to form first and second press nips $P_1$ and $P_2$. While the special arrangement showing the two nips provides advantages in two successive nips with the web W being supported on the belt being carried automatically through two nips, the principles employed are those shown in the above referred-to Justus U.S. Pat. No. 3,783,097, the disclosure of which is incorporated herein by reference.

In FIG. 1, the press nip $P_1$ is formed between the roll 13 and the belt 10 and a sliding pressure shoe 15 bears against the smooth surface of the belt and has an inner smooth surface and a hydraulic film of lubricating oil is built up between the belt and the shoe with the oil being supplied by an elongate nozzle 20 which extends across ahead of the shoe with the oil being caught between the relieved leading edge of the shoe 15. The shoe is supported on a roll pin 18 and is forced toward the belt by a piston and cylinder arrangement shown schematically at 17. This piston and cylinder arrangement also supports an opposite shoe 16 which presses toward the roll 14 to form the second press $P_2$. The piston and shoe arrangement 17 presses the shoe 16 against the belt on a roll pin 19 so that the forces applied by the piston and cylinder assembly 17 are equal and opposite for cancellation of forces.

Lubricating oil is delivered to the lead end of the shoe 16 through a nozzle arrangement 21 so that a film of lubricating fluid is built up between the shoe 16 and the belt 10. A felt 24 passes through the first press to receive water expressed from the web, and a felt 25 passes through the second press to receive water expressed from the web.

As the web W is carried on the belt through the two presses, it is subjected to pressing pressure over the length of the elongate concave arcuate face of each of the shoe 15 and 16 to permit water to be presses from the fibrous web and to migrate into the felts 24 and 25.

Lubricating oil which builds up the hydraulic film between the shoe and belt is carried with the belt on the trailing end of the shoe and must be removed so that it is not carried up with the belt around the rolls 11 and 12 and so that it is not permitted to be thrown off the edge of the belt or to migrate around the edge of the belt onto the web face of the belt. The structures for removal of the lubricating oil from the inner surface of the belt are shown at 22 and 23. The unit 22 for removal of the lubricating oil includes blades in sequence which have their leading edge in close running contact with the belt to doctor the oil from the surface. The oil is picked up by oil removal means such as suction nozzles, not shown.

For the oil removal apparatus 23, blades **23*a* and 23*b*** are provided with their leading edges in close running contact with the inner smooth surface of the belt and the removed oil is picked up by suitable means.

The extended presses are operable at machine speeds of up to 5,000 feet per minute, and the lubricating oil which forms the hydraulic film between the shoes and the belts operates at shoe pressures of 600 psi. The oil must provide an adequate flow of lubricating oil so as to aid in maintaining uniform press pressure between the belt and the web and to prevent scuffing of the belt and it has been discovered that oil ust be provided in volumes of 0.2–1.0 gallons per minute per inch of machine width, and these quantities of oil must be provided and again removed to eliminate the possibility of contaminating the closely adjacent newly formed web.

Figure 6:
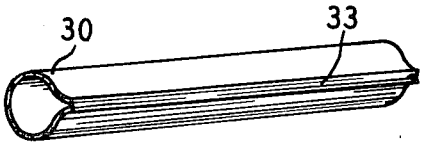
FIG. 6 through FIG. 8 are fragmentary perspective views showing three forms of lubricant supply nozzles.
Figure 7:
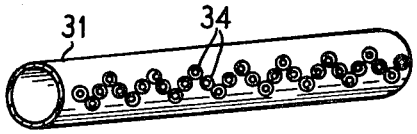
Figure 8:
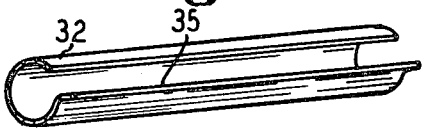

The hydraulic oil must be provided at a uniform controlled rate which does not provide an excess of oil or risk a deficiency of oil. Examples of nozzles for providing oil in advance of the shoe are shown in FIGS. 6, 7 nd 8. Each of nozzles shown therein is provided with an oil supply that delivers oil into the chamber throughout the elongate nozzle to flow out to the delivery means onto the belt. The nozzle arrangement shown in FIG. 6 is a preferred form and has an elongate continuous slot 33 to deliver oil onto the belt. The arrangement of FIG. 7 has a series of separate openings 34 for the delivery of oil. The arrangement of FIG. 8 has an open gap so that oil fills the channel below the gap to flow out in a wier type of effect onto the traveling belt.

Figure 5:
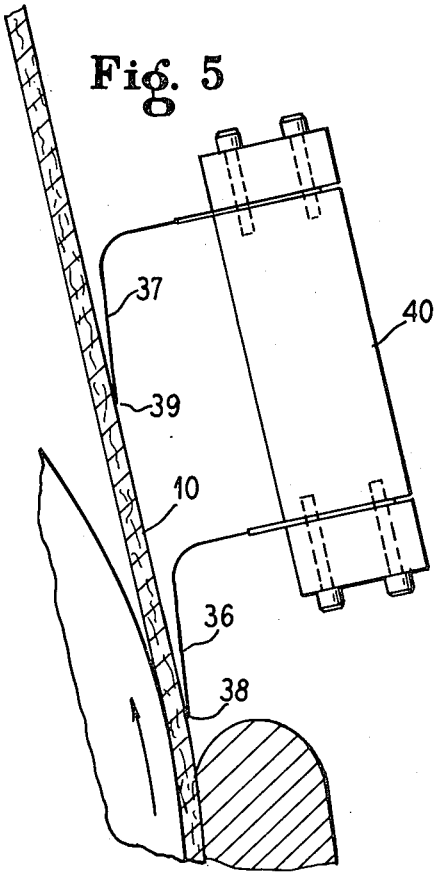
FIG. 5 is an enlarged side elevational view, partially in section showing a preferred form of lubricant wipers.

It has been discovered that to prevent the escape of oil onto adjacent machine parts and onto the newly formed web, approximately 95% or more of the oil must be removed from the inner surface of the belt on the offrunning side of the shoe. A preferred arrangement for the removal of the oil is the employment of a flexible plastic wiper blade which has a free leading edge in close running contact with the smooth surface of the belt. A plastic blade formed of a polycarbonate plastic such as sold under the General Electric tradename "Lexan" has proven desirable with a thickness in the range of 0.020"–0.060" with the length of approximately 3'. A preferred form of structure wherein the elasticity of the blade is used to hold it into contact with the belt is shown in FIG. 5 wherein first and second blades 36 and 37 are clamped and held in a blade support 40. The leading edges 38 and 39 are in sliding contact with the smooth surface of the belt 10. Means are provided for removal of the oil which creeps over the inner surface of the blade as the blade doctors the oil off the belt with these means being in the form of nozles, not shown in FIG. 5.

FIG. 2 illustrates a plurality of these blades being carried in an assembly with the blades being shown at 44 supported on a back 43. Additional blades or fewer blades may be provided and/or a second assembly spaced slightly downstream from the first assembly may be additionally provided, each adjusted so that the leading edge of the blade projects toward and is in sliding contact with the belt.

Figure 4:
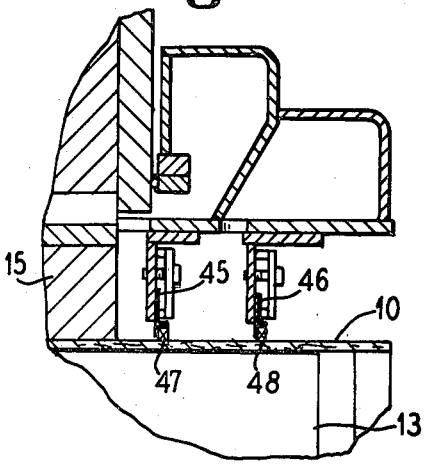
FIG. 4 is another inverted sectional view similar to FIG. 3 showing another form of edge wipers.

FIGS. 3 and 4 illustrate edge wipers positioned in sliding contact with the belt outwardly beyond the outer edges of the shoe 15. The belt 10 is wider than the shoe 15 and to prevent the oil which is squeezed out from beneath the edge of the shoe from migrating laterally around the edge of the belt, longitudinal wiper blades 51 and 52 supported in backs 49 and 50 are provided in sliding contact with the surface of the belt.

These blades 51 and 52 have a lower flexible edge projecting inwardly in the direction of the shoe and elastically pressing against the belt surface.

FIG. 4 shows another form wherein holders 45 and 46 carry sliding wipers 47 and 48 at their lower edge in sliding contact with the belt 10 outside the outer edge of the shoe 15.

Figure 9:
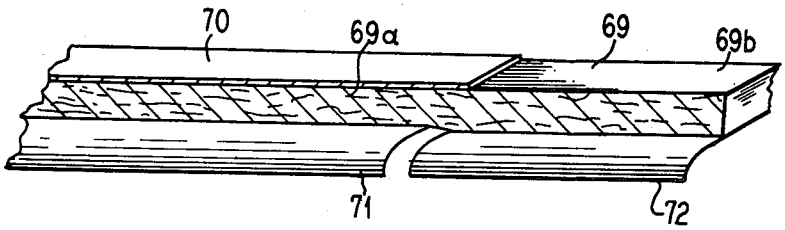
FIG. 9 is a fragmentary perspective view showing a form of lubricant wiping blade arrangement.

As will be noted from FIGS. 3 and 4, the portion of the belt which passes beneath the shoe is compressed, and the portion laterally outside the edge of the shoe is uncompressed. The belt is formed of a very tough fibrous rubber material, but at nip pressures of 600 psi, compression or a squeezing of the belt will occur so that the portion of the belt which passes out from under the trailing end of the shoe will be thinner than the portion of the belt immediately beside the shoe. The lubricating oil should be removed as soon as possible, and at high speeds the belt will not yet have regained its normal thickness, Thus, in the arrangement illustrated in FIG. 9, the wiping blade is arranged in segments with a primary wiping blade 71 being of the width of the shoe to engage that portion of the belt. An auxiliary wiping blade 72 engages the uncompressed area of the belt. Thus, the primary wiping blade 71 has its leading edge operating at a different level than the auxiliary wiping blade 72 to accommodate the difference in thickness of the belt. As will be seen from FIG. 9, the portion 69*a* of the belt is compressed, and the portion 69*b* is uncompressed, and the felt 70 is shown on the web side of the belt 69. In some instances it may be desirable to also include means such as a wiper blade on the web side of the belt 69 in the area laterally besides the felt to remove any lubricant that may possibly migrate around the belt edge.

Figure 10:
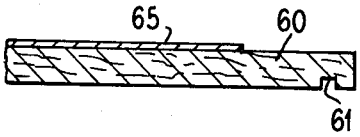
FIGS. 10 through 12 are fragmentary sectional views showing edge constructions of belts.
Figure 11:
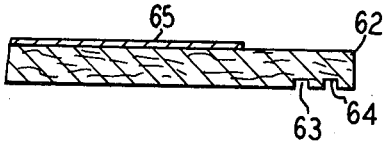
Figure 12:
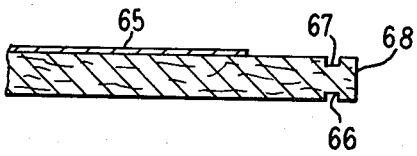

In FIGS. 10 through 12, means are provided at aid in preventing the migration of the lubricant onto the web side of the belt. In FIG. 10, the belt is shown at 60 with a felt 65 carrying the web. At the edge of the belt on the shoe face thereof is a longitudinal groove 61 which extends continuously. This groove will provide lateral faces at each side of the groove which will tend to throw the oil and prevent the oil from passing laterially around the edge of the belt.

The arrangement of FIGS. 11 employs a belt 62 with a felt 65 and two parallel grooves 63 and 64 at the belt edge outside of the shoe, on the shoe surface of the belt.

In the arrangement of FIG. 12, the belt 65 is provided with a groove 66 on the shoe face and an additional groove 67 on the web face of the belt, both of which function to prevent the migration of lubricating oil around the edge of the belt to contaminate the web.

In operation as illustrated in FIG. 5, the belt 10 will be carrying a layer of hydraulic lubricant with it out from under the shoe 15, and this lubricant will be continually wiped from the belt by the thin elastic flexible plastic blades 36 and 37, and the collected lubricant will be drawn off by suction nozzles. In continuous operation, speeds up to 5,000 feet per minute can be accomplished with the superior dewatering effect which is possible with an extended press.

I claim as my invention:

1. A wet press mechanism for removing liquid from a traveling fibrous web comprising in combination:

a press nip formed between first and second members for receiving a traveling web therebetween;

one of said members being a traveling flexible impervious belt;

force means engaging the surface of said belt including a sliding shoe having a surface facing the belt with said surface extending transversely across the belt and being of a width less than the belt and also extending in the direction of belt travel to form an extended nip press;

means for pressing the shoe toward the belt with a predetermined force whereby the belt is compressed opposite the shoe and is uncompressed laterally of the shoe;

means for providing a film of lubricating fluid between the shoe and the belt;

means for receiving liquid pressed from the web between said members;

and means positioned laterally of the shoe opposite the uncompressed portion of the belt for removing lubricant from the surface of the belt at the uncompressed belt area which lubricant has passed laterally alongside the shoe.

2. A press wet mechanism for removing liquid from a traveling fibrous web constructed in accordance with claim 1:

wherein said removal means removes lubricant from the web side of the belt.

3. A wet press mechanism for removing liquid from a traveling fibrous web constructed in accordance with claim 1:

wherein said removing means is in the form of a scraper positioned adjacent the belt surface and spaced so as to accommodate the thicker uncompressed portion of the belt.

4. A wet press mechanism for removing liquid from a traveling fibrous web constructed in accordance with claim 1:

including a primary lubricating fluid removal means positioned following the shoe adjacent the belt surface removing lubricant from the surface of the belt portion which has been compressed by the shoe.

5. A wet press mechanism for removing liquid from a traveling fibrous web constructed in accordance with claim 4:

wherein said primary means is in the form of a primary wiping blade which is the width of the shoe.

6. A wet press mechanism for removing liquid from a traveling fibrous web constructed in accordance with claim 5:

wherein said means laterally of the shoe is in the form of an auxiliary wiping blade and the primary and auxiliary wiping blades are located laterallay adjacent each other.

7. A wet process mechanism for removing liquid from a traveling fibrous web constructed in accordance with claim 6:

wherein said primary wiping blade and said auxiliary wiping blade are positioned for operating at different levels to accommodate the difference in thickness of the belt.

8. A wet press mechanism for removing liquid from a traveling fibrous web constructed in accordance with claim 1:

wherein said means positioned laterally of the shoe is located on the shoe side of the belt.

9. A wet press mechanism for removing liquid from a traveling fibrous web constructed in accordance with claim 8:

including a felt on the side of the belt opposite the shoe with means at the side of the felt for removing lubricant from the surface of the belt which may have migrated around the belt edge.

* * * * *